US008567371B2

(12) United States Patent
Vaughn et al.

(10) Patent No.: US 8,567,371 B2
(45) **Date of Patent: *Oct. 29, 2013**

(54) THROTTLE AUTO IDLE WITH BLADE BRAKE CLUTCH

(75) Inventors: Christopher W. Vaughn, Mebane, NC (US); Jeffrey A. Wians, Mebane, NC (US)

(73) Assignee: Honda Motor Co., Ltd., Tokyo (JP)

( * ) Notice: Subject to any disclaimer, the term of this patent is extended or adjusted under 35 U.S.C. 154(b) by 687 days.

This patent is subject to a terminal disclaimer.

(21) Appl. No.: 12/715,722

(22) Filed: Mar. 2, 2010

(65) Prior Publication Data

US 2011/0214641 A1 Sep. 8, 2011

(51) Int. Cl.
*F02D 31/00* (2006.01)

(52) U.S. Cl.
USPC ..... 123/376; 123/339.1

(58) Field of Classification Search
USPC ..... 123/376, 339.1, 339.16, 319, 389, 123/399–401, 378, 377
See application file for complete search history.

(56) References Cited

U.S. PATENT DOCUMENTS 2,134,889 A * 11/1938 Phillips ..... 123/344
3,388,763 A * 6/1968 Reichard ..... 180/174
3,502,167 A * 3/1970 Baxter et al. ..... 180/175
4,148,173 A * 4/1979 Hoff ..... 56/11.3
4,221,108 A 9/1980 Owens
4,277,936 A 7/1981 Hoff
4,309,862 A 1/1982 Carlson
4,316,355 A * 2/1982 Hoff ..... 56/11.3
4,416,107 A * 11/1983 Hoff ..... 56/11.3
4,696,150 A 9/1987 Geeck, III
5,003,949 A * 4/1991 Fanner et al. ..... 123/382
5,040,507 A * 8/1991 Hayes et al. ..... 123/339.2
5,146,889 A * 9/1992 Swanson et al. ..... 123/376
5,203,302 A * 4/1993 Parnitzke ..... 123/376
5,235,943 A * 8/1993 Fiorenza, II ..... 123/179.18
6,116,350 A * 9/2000 Notaras et al. ..... 172/15
6,167,973 B1 1/2001 Nagashima
6,729,298 B1 * 5/2004 Sterr ..... 123/339.13
6,971,369 B1 * 12/2005 Mitchell et al. ..... 123/376
6,983,736 B2 * 1/2006 Mitchell et al. ..... 123/376
7,093,580 B2 * 8/2006 McLeod ..... 123/376
7,152,580 B2 * 12/2006 Wetor et al. ..... 123/376
7,246,794 B2 * 7/2007 Suzuki et al. ..... 261/52
7,318,407 B1 * 1/2008 Klonis et al. ..... 123/376
7,343,898 B1 * 3/2008 Caldwell et al. ..... 123/376
7,370,458 B2 5/2008 Matsuda et al.
7,886,716 B1 * 2/2011 Arai et al. ..... 123/400
7,950,366 B2 * 5/2011 Arai et al. ..... 123/376
2003/0029418 A1 * 2/2003 Deschamps et al. ..... 123/376

(Continued)

*Primary Examiner* — Willis R Wolfe, Jr.
*Assistant Examiner* — Johnny Hoang
(74) *Attorney, Agent, or Firm* — Jenkins, Wilson, Taylor & Hunt, P.A.

(57) ABSTRACT

Systems, devices, and methods are disclosed for automatically adjusting a speed of an engine in response to the loading on the engine. In particular, an automatic idle system and method can comprise a governor linkage with a first end for connection to the rotatable shaft of an engine governor and a second end for connection to a throttle control of the engine, and an actuator connected to the second end of the governor linkage. The actuator can be movable in response to a load on the engine to move the governor linkage from a base position to an adjusted position. In this arrangement, when the engine is in a low-load state, the governor linkage can be moved toward a throttle-closed position.

15 Claims, 8 Drawing Sheets

(56) References Cited

U.S. PATENT DOCUMENTS

| | | | | |
|---|---|---|---|---|
| 2003/0196638 | A1* | 10/2003 | Matsuda et al. | 123/342 |
| 2004/0035394 | A1* | 2/2004 | Gerhardy | 123/400 |
| 2004/0112333 | A1* | 6/2004 | Mitchell et al. | 123/376 |
| 2005/0155573 | A1* | 7/2005 | McLeod | 123/376 |
| 2006/0130808 | A1* | 6/2006 | Steffes et al. | 123/376 |
| 2007/0114076 | A1* | 5/2007 | Osborne | 180/19.3 |
| 2007/0186899 | A1* | 8/2007 | Nishimura et al. | 123/364 |
| 2007/0273152 | A1* | 11/2007 | Kawakami et al. | 290/17 |
| 2008/0014096 | A1* | 1/2008 | Gilpatrick | 417/34 |
| 2008/0264027 | A1* | 10/2008 | Kaskawitz et al. | 56/11.3 |
| 2011/0005024 | A1* | 1/2011 | Spitler et al. | 15/320 |

* cited by examiner

THROTTLE AUTO IDLE WITH BLADE BRAKE CLUTCH

TECHNICAL FIELD

The subject matter disclosed herein relates generally to throttle systems. More particularly, the subject matter disclosed herein relates to throttle systems and related methods for engines having blade brake clutches.

BACKGROUND

Past designs for rotary lawnmowers commonly had the blade fixed directly to the depending drive shaft of an engine. Concerns were raised, however, regarding the danger and other disadvantages of such an arrangement. For instance, having the blade constantly spin even during starting and idling presents inherent dangers as the engine drive shaft can be bent when the blade strikes an obstruction and overloading of a direct-driven blade can stall the engine, to name a few issues. As a result, manufacturers began implementing clutch systems into lawnmower designs that allowed the blade to be disengaged without stopping the engine. One example of such a system is a blade brake and clutch system disclosed in U.S. Pat. No. 6,464,055, the disclosure of which is incorporated by reference herein in its entirety.

Because of the great difference in loading experienced by the engine between an engaged state and a disengaged state, however, some form of speed regulation device is often required to help keep the engine within desired operating ranges. Current lawnmower designs generally employ one of two configurations to control the speed of the engine. In a fixed throttle configuration, the engine speed is fixed at the maximum desirable running speed (e.g., about 3150 rpm for lawnmowers). As a result, even when the blade is disengaged from the engine, the unloading of the engine will not cause the engine to speed to exceed this predetermined limit. Alternatively, in a variable throttle configuration, the engine speed is variable in response to operation of a throttle control accessible to the operator. In this way, the operator can move this throttle control to reduce the engine speed when the blade is not engaged (e.g., when the operator is dumping the grass bag).

Each of these arrangements has advantages and drawbacks. For instance, a fixed throttle configuration does not require any additional operator input to control the engine speed, but the engine speed always races to the maximum running speed when the engine is unloaded due to governor system balancing, which can result in noisy idling. Also, these high engine speeds in the unloaded condition can result in higher fuel consumption and higher heat generation, which is particularly a concern in air-cooled engines. In variable throttle configurations, although the engine speed can be reduced in unloaded operation, this reduction generally requires the operation of a separate throttle control. Accordingly, until the operator takes the additional step to adjust the throttle control, problems with noise and high fuel consumption due to the engine racing to high speeds can likewise be problematic.

As a result, it would be desirable for a throttle system of an engine to automatically reduce the engine speed when the engine is moved into an unloaded state, such as when a blade of a lawnmower is disengaged.

SUMMARY

In accordance with this disclosure, systems, devices, and methods for automatically adjusting a speed of an engine in response to the loading on the engine are provided. In one aspect, an automatic idle system for an engine is provided. The automatic idle system can comprise an engine speed governor for connection to an engine, and the governor can comprise a governor shaft rotatable in response to a speed of the engine. A governor linkage can comprise a first end for connection to the governor shaft and a second end for connection to a throttle control of the engine, and an actuator can be connected to the second end of the governor linkage. The actuator can be movable in response to a load on the engine to move the governor linkage from a base position to an adjusted position. In this arrangement, when the engine is in a low-load state, the governor linkage can be moved toward a throttle-closed position.

In another aspect, a lawnmower can be provided. The lawnmower can comprise an engine drivingly engaged to a rotary blade, and the engine can comprise an adjustable throttle and a blade brake control movable between an engaged position in which the blade is prevented from rotating and a disengaged position in which the blade is free to rotate with the engine. The lawnmower can further comprise an engine speed governor coupled to the engine, and the governor can comprise a governor shaft rotatable in response to a speed of the engine, a governor linkage comprising a first end for connection to the governor shaft and a second end for connection to a throttle control of the engine, and an actuator connected to the second end of the governor linkage. Again, the actuator can be movable in response to a load on the engine to move the governor linkage from a base position to an adjusted position. As a result, when the engine is in a low-load state, the governor linkage can be moved toward a throttle-closed position.

In yet another aspect, a method for automatically adjusting the speed of an engine of a lawnmower is provided. The method can include coupling an engine speed governor to an engine, the governor comprising a governor shaft rotatable in response to a speed of the engine, connecting a governor linkage between the governor shaft and a throttle control of the engine, the governor linkage comprising a first end connected to the governor shaft and a second end connected to the throttle control, and moving an actuator in response to the operation of a blade brake control to move the governor linkage from a base position to an adjusted position. When the blade brake control is moved to an engaged position, the governor linkage can moved toward a throttle-closed position.

Although some of the aspects of the subject matter disclosed herein have been stated hereinabove, and which are achieved in whole or in part by the presently disclosed subject matter, other aspects will become evident as the description proceeds when taken in connection with the accompanying drawings as best described hereinbelow.

BRIEF DESCRIPTION OF THE DRAWINGS

The features and advantages of the present subject matter will be more readily understood from the following detailed description which should be read in conjunction with the accompanying drawings that are given merely by way of explanatory and non-limiting example, and in which.

DETAILED DESCRIPTION

Figure 1:
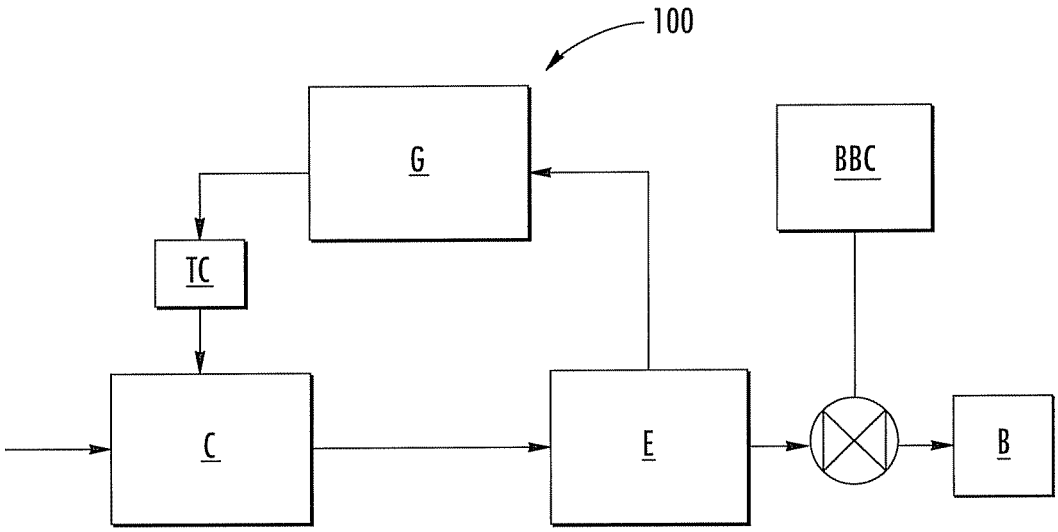
FIG. 1 is a schematic diagram of the interconnection of components in an automatic low speed idle system according to one example of an embodiment of the presently disclosed subject matter.

The present subject matter provides throttle systems and related methods for engines connected to a driven element that can be alternately engaged and disengaged from the engine. In one aspect, the present subject matter provides an automatic idle system for an engine that is designed to automatically lower the engine speed below the governed speed range when the engine is in a low-load state (i.e., in a lawnmower, when a cutting blade is disengaged). In particular, referring to FIG. 1, an engine E can generally comprise a carburetor C that can be located in the intake tract of engine E, and carburetor C can comprise a throttle control TC for controlling the delivery of the fuel/air mixture from carburetor C to engine E. In one particular embodiment, for example, engine E can be a small engine configured to drive a rotary lawnmower. In particular, engine can drive a cutting blade B, which can be engaged and disengaged by the operation of a blade brake clutch control, generally designated BBC.

Regardless of the specific use of engine E, an automatic idle system, generally designated 100, can comprise an engine speed governor G coupled to engine E. Referring to the particular configuration illustrated in FIG. 2, governor G can have a governor shaft GS rotatable in response to a speed of engine E. A governor linkage, generally designated 110 can function in a manner similar to a governor arm of a conventional speed regulation system. Specifically, governor linkage 110 can have a first end 120 for connection to governor shaft GS and a second end 130 for connection to throttle control TC of engine E. In this regard, governor linkage 110 can be integrated into a speed regulation system having many of the same components as the conventional system, which can comprise one or more of a governor spring 122 connecting governor linkage 110 to a fixed frame element 124 helping to return governor linkage 110 to its initial position once the engine speed is reduced, a governor rod 132 connecting governor linkage 110 to throttle control TC, or a governor rod spring 134 to dampen fluctuations in the position of governor linkage 110 caused by small variations in the engine speed.

Figure 2:
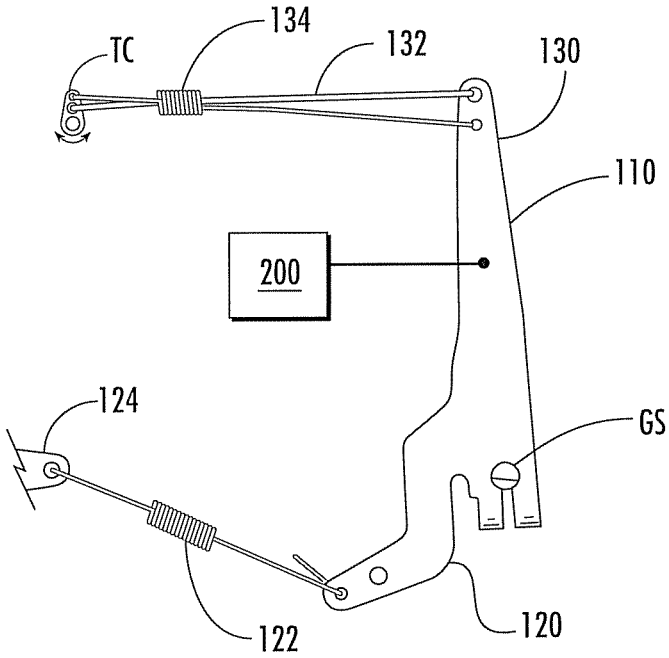
FIG. 2 is a side view of a movable governor linkage for an automatic idle system according to an embodiment of the presently disclosed subject matter.

In contrast to conventional governor arms, however, governor linkage 110 can further be connected to an actuator, generally designated A in FIG. 2, that can be movable in response to a load on engine E. For instance, actuator A can be connected to second end 130 of governor linkage 110 to move governor linkage 110 from a base position to an adjusted position. In this arrangement, by altering the base position of governor linkage 110, actuator A can essentially automatically adjust (e.g., decrease) the maximum governed speed range of engine E. Thus, when engine E is in a low-load state (e.g., cutting blade disengaged), governor linkage 110 can be automatically moved toward a throttle-closed position, and when engine E is in a high-load state (e.g., cutting blade engaged) governor linkage 110 can be in a throttle-open position.

For example, in configurations where governor spring 122 connects governor linkage 110 to a fixed frame element 124, governor linkage 110 can be biased towards a throttle-open position, and operation of actuator A can move governor linkage 110 against this bias of spring 122 to move governor linkage 110 towards a throttle-closed position. The automatic throttle system described can thus provide advantages over current lawnmower throttle designs by automatically reducing the speed of engine E when it is moved into an unloaded state.

Figure 3A:
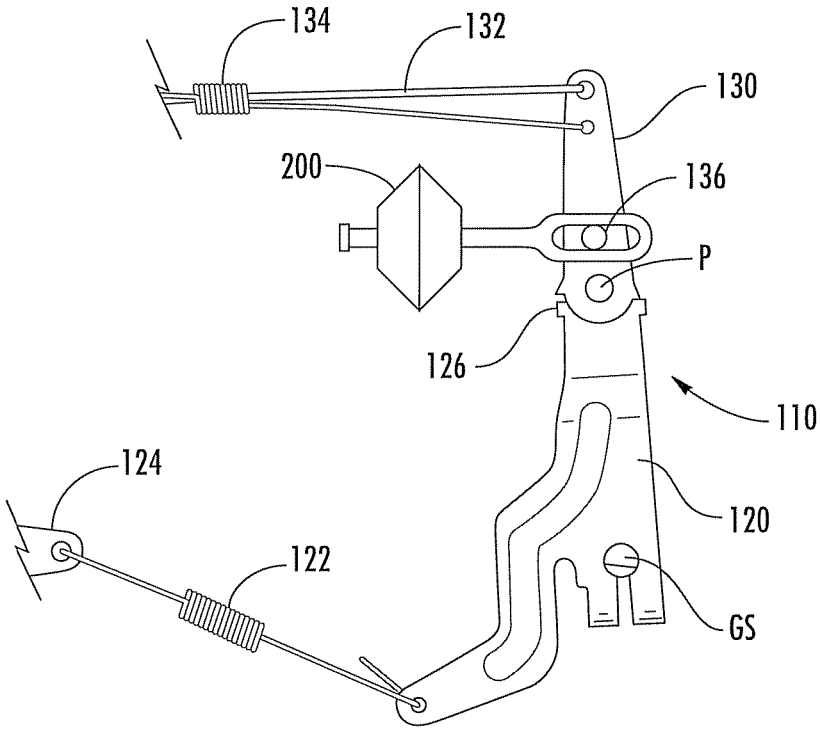
FIGS. 3A through 3C are side views of a multi-piece governor linkage in three different operating positions according to an embodiment of the presently disclosed subject matter.
Figure 3B:
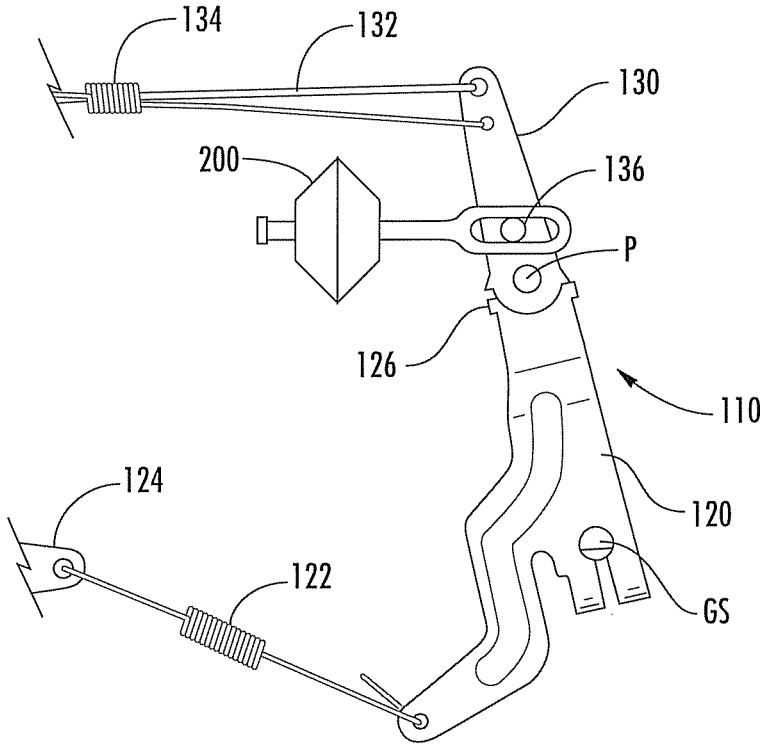
Figure 3C:
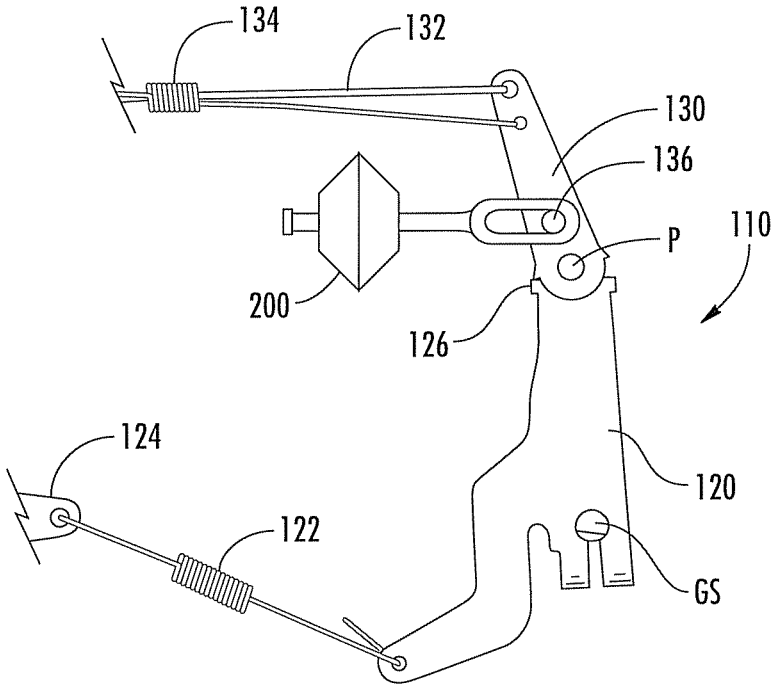
Figure 4:
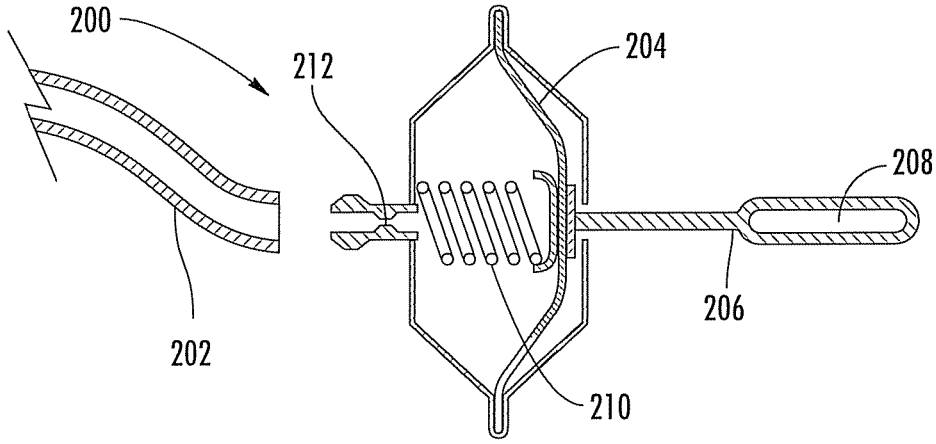
FIG. 4 is a sectional side view of a vacuum actuator for use with an automatic idle system according to the embodiment shown in FIGS. 3A through 3C.

There are a number of components that can function as actuator A. In a first configuration illustrated in FIGS. 3A-3C, 4, and 5A-5B, for example, actuator A can be a vacuum actuator 200 driven by intake vacuum to actuate governor linkage 110. Specifically, referring to FIG. 4, vacuum actuator 200 can be connected by flexible tubing 202 to a passage in an intake system vacuum source, such as a carburetor insulator CI in communication with an intake tract between throttle control TC and an engine intake valve. A restriction 212 can be located in the passage or in vacuum actuator 200 itself to minimize the pulsation effect caused by unsteady flow in the intake tract. Vacuum actuator 200 can comprise a diaphragm 204 movable in response to pressure in carburetor C and an actuation rod 206 having a first end attached to diaphragm 204 and a second end coupled to second end 130 of governor linkage 110 (shown in FIGS. 3A-3C).

For instance, second end 130 can have a raised feature 136 (shown in FIGS. 3A-3C) to which an actuator slot 208 on the second end of actuation rod 206 can be coupled. Alternatively, second end 130 can have a linkage slot 138 (shown in FIGS. 5A and 5B) into which the second end of actuation rod 206 can be coupled. In either configuration, movement of actuation rod 206 can cause the movement of governor linkage 110, but any movement of governor linkage 110 in response to changes in the engine speed will not necessarily be transferred to vacuum actuator 200 because of either of linkage slot 138 or actuator slot 208.

Figure 5A:
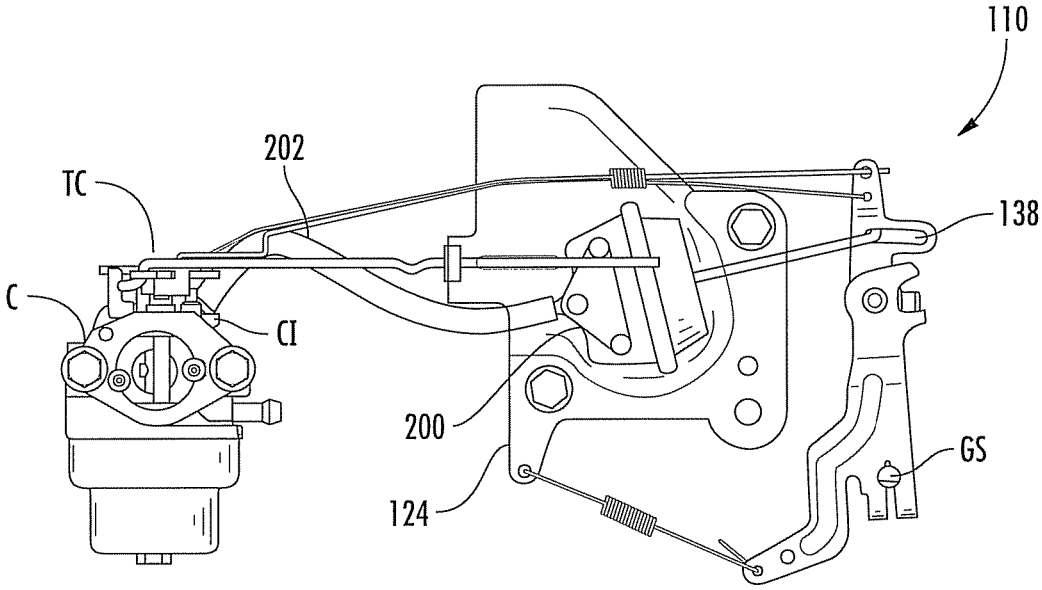
FIGS. 5A and 5B are side views of an automatic idle system in different operating positions according to the embodiment shown in FIGS. 3A through 3C.
Figure 5B:
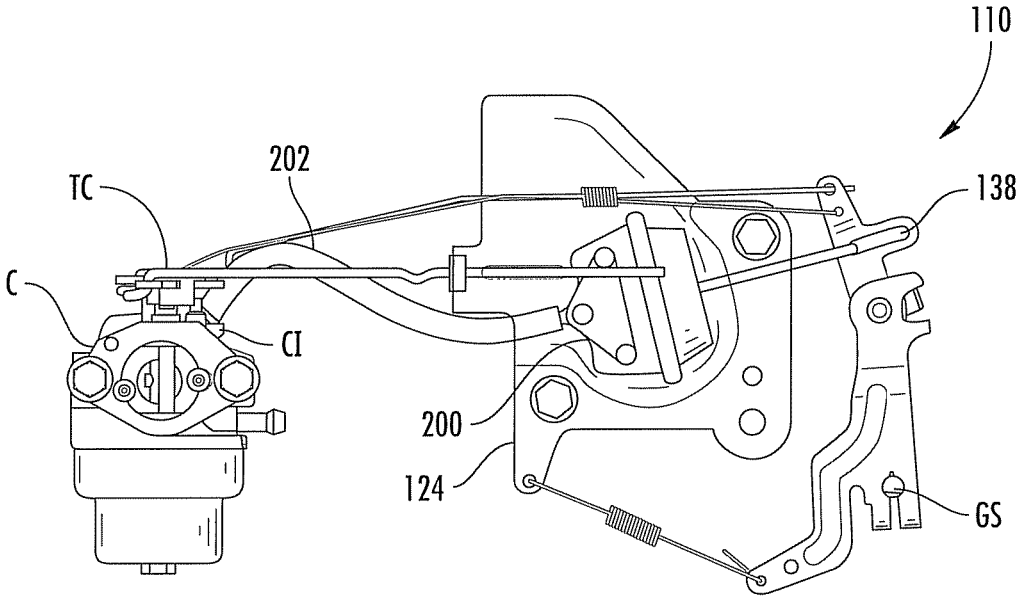

Regardless of the specific configuration, vacuum actuator 200 can thus be connected between carburetor C and governor linkage 110. Referring to the system shown in FIG. 5A, when there is a load on engine E, the pressure in the intake system vacuum source will generally be relatively high. In such a situation, vacuum actuator 200 will not exert a force on governor linkage 110, and thus governor linkage 110 can operate in a manner similar to a typical pivoting governor arm. Referring to FIG. 5B, when engine E is in a low-load state, however, the decreased pressure in the intake system vacuum source can cause vacuum actuator 200 to exert a force on governor linkage 110. In this way, governor linkage 110 can automatically be moved from the base position to an adjusted position, which in turn moves throttle control TC toward a throttle-closed position.

In this arrangement, the engine's natural vacuum characteristics can move vacuum actuator 200 to the appropriate position depending on whether engine E should run in the high governed speed range or in the low speed idle state. For instance, the average intake tract pressure can change as a function of engine speed and throttle angle. Throttle angle can be related to engine torque, and although it is not a linear relationship, generally a greater throttle angle indicates a greater engine torque. As a result, it can be understood that average engine intake tract pressure can decrease with decreasing load.

Therefore, as discussed above, vacuum actuator 200 can be designed such that at high loads, when the intake tract pressure can be relatively close to atmospheric pressure, vacuum actuator 200 can move actuation rod 206 to be in an extended position. Further, vacuum actuator 200 can have an internal spring, generally designated 210, that applies a force on diaphragm 204 to return actuation rod 206 to its extended position when the internal pressure is above a certain level. Conversely, at low loads, the relatively low intake tract pressure causes vacuum actuator 200 to move actuation rod 206 to a retracted position.

With a configuration such as described above, the system can, for example, operate as follows. When engine E is running at a high load, the intake tract pressure can be high enough that actuation rod 206 of vacuum actuator 200 can be in its extended position, allowing the governor system to move freely without any effects. Therefore in a high load condition, governor linkage 110 can be both geometrically and functionally the same as it would be on an engine equipped with a conventional governor arm arrangement. This configuration thus causes engine E to run in its typical, relatively high speed range when the engine is loaded (e.g., when the blade is engaged).

When engine E is running at a light load, the intake tract pressure can be low enough that actuation rod 206 of vacuum actuator 200 can be in its retracted position. This position causes governor linkage 110 to move, such as by pivoting, thereby moving throttle control TC to close the carburetor throttle and thereby reduce the engine speed. The net result of these actions can be a relatively low idle speed when the load on engine E is low.

For example, if automatic idle system 100 is incorporated into a lawnmower, a blade brake clutch control BBC, such as a deadman switch on the lawnmower handle, can be moved between a disengaged position in which cutting blade B is disengaged from engine E and an engaged position in which cutting blade B is engaged for rotation by engine E. In the engaged position, the driving operation of cutting blade B exerts a load on engine E. While this load is applied, automatic idle system 100 can operate in a manner substantially similar to a traditional governor arm. When blade brake clutch control BBC is released to disengage cutting blade B, however, the reduction of load on engine E can cause vacuum actuator 200 to move governor linkage 110 so that throttle control TC is moved toward a throttle-closed position. As a result, engine E can automatically idle at a much lower speed when little or no load is applied to the engine. This automatic idle can help to reduce the level of noise emitted from the engine, increase the life of the engine by reducing the number of revolutions of the engine (per unit time) when little or no load is applied, and decrease the overall fuel consumption of the engine because the engine consumes less fuel when it is idling at lower speeds.

Figure 6:
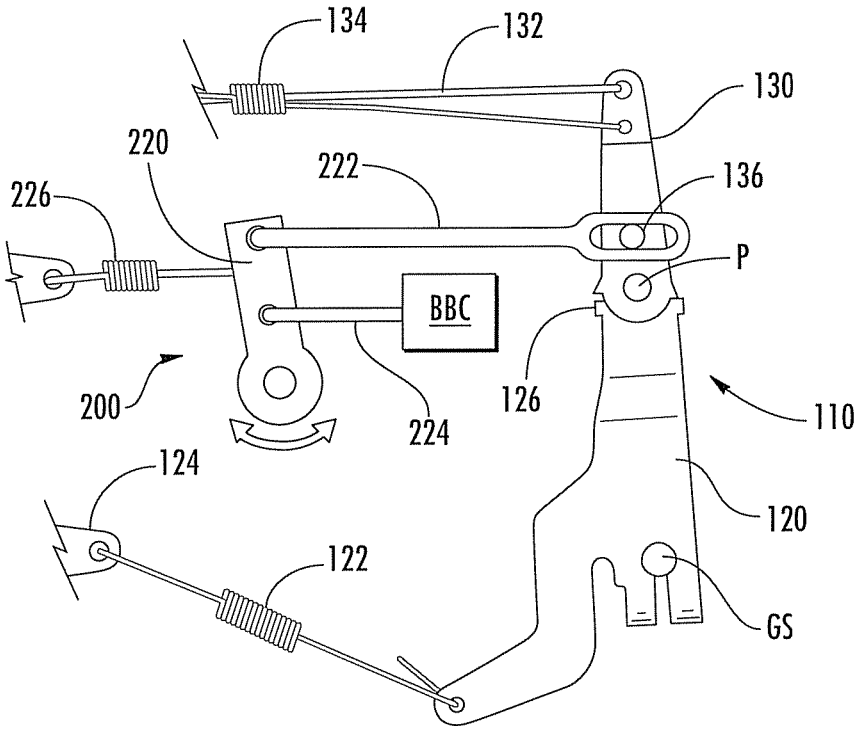
FIG. 6 is a side view of a multi-piece governor linkage according to an embodiment of the presently disclosed subject matter.
Figure 7:
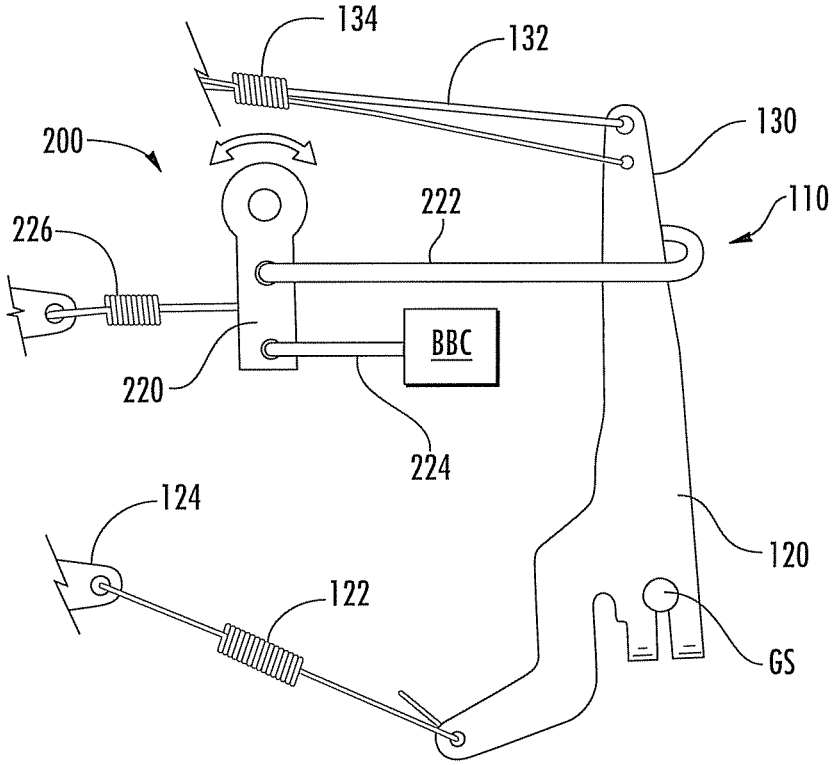
FIG. 7 is a side view of a single-piece governor linkage according to an embodiment of the presently disclosed subject matter.

In a second configuration shown in FIGS. 6 and 7, actuator A can be a pivoting actuator 220 comprising a rod 224 actuated by a lever 222, which can in turn be actuated by a connector 226 (e.g., a Bowden cable) in communication with blade brake clutch control BBC. Further, pivoting actuator 220 can comprise a spring 228 for creating a biasing force that opposes the force applied to lever 222 by connector 226. These components can all be mounted to engine E in a way similar to the mounting of the control assembly in a variable throttle engine, except that the governor spring mounting hole can have a fixed location.

In this arrangement, when blade brake clutch control BBC is released such that cutting blade B is disengaged from engine E, spring 228 can apply a force to move lever 222 away from governor linkage 110 such that actuator rod 224 can move governor linkage 110 from the base position towards the adjusted position, which in turn moves throttle control TC toward a throttle-closed position. Conversely, when blade brake clutch control BBC is activated such that cutting blade B is engaged with engine E, connector 226 can move lever 222 against the bias of spring 228, which can thereby move actuator rod 224 toward governor linkage 110 and allow governor linkage 110 to return to a base, throttle-open position. As a result, in contrast to the vacuum actuator system discussed above, this lever-actuator configuration adjusts the position of governor linkage 110 directly in response to engagement of blade brake clutch control BBC rather than responding to the downstream effect of such engagement via the intake system vacuum source.

In either of the configurations of automatic idle system 100 described above, governor linkage 110 can likewise be provided in any of a number of configurations. For instance, referring to FIGS. 3A-3B and 6, governor linkage 110 can be a multi-piece component. In particular, first end 120 and second end 130 can be on two separate portions of governor linkage 110. A first portion comprising first end 120 can be movably connected with a second portion with a second end 130, such as by being pivotably coupled to at a pivot point P.

Despite governor linkage 110 comprising multiple pieces in this configuration rather than a single governor arm, governor linkage 110 can function in a substantially similar manner to the conventional governor arm under loaded conditions. Specifically, when the speed of engine E is relatively low, governor linkage 110 can be in a base position (e.g., "straight" position) shown in FIG. 3A, for instance due to the mount position of governor spring 134 with respect to carburetor C tending to rotate second end 130 of governor linkage 110 clockwise. Governor linkage 110 can further comprise a stop to prevent second end 130 from rotating past this base position. When the engine speed increases, governor shaft GS can be rotated, causing governor linkage 110 to move toward a throttle-closing position shown in FIG. 3B, which is similar to the operation of a conventional governor arm.

The multi-piece configuration of governor linkage 110 provides additional functionality, however, by adjusting the position of throttle control TC depending on the load on the engine and/or the engagement of blade brake clutch control as well as on the speed of the engine. To accomplish this load-based adjustment, actuator 200 can be connected to second end 130 of governor linkage 110. As discussed above, actuator A can be movable in response to a load on engine E or engagement of blade brake clutch control BBC to move second end 130 relative to first end 120, such as by pivoting, from the base position to an adjusted position. Specifically, when the engine is in a low-load state (e.g., blade brake clutch disengaged), actuator A can move second end 130 to the adjusted position in which second end 130 is moved or pivoted relative to first end 120 to move throttle control TC toward a throttle-closed position.

Once a load is placed on the engine, actuator A can allow second end 130 to move back so that governor linkage 110 is again in the base position. In addition, governor linkage 110 can further comprise a rigid stop 126 to prevent second end 130 from moving further than a maximum desired rotation to limit the amount that the operation of actuator A can affect the adjustment of throttle control TC. Governor linkage can also comprise a biasing mechanism, such as a spring, which can bias second end 130 toward the base position. In addition, actuator A can be designed so that the operation of engine governor G is able to overcome the force applied by actuator A without a substantial decrease in the engine speed after the engine encounters a load. In this way, automatic idle system 100 allows engine E to respond quickly to the load condition.

As an alternative to this multi-piece configuration, governor linkage 110 can be a single governor arm similar to those used in typical governor systems. In such a configuration, illustrated in FIG. 7, movement of actuator A (e.g., a pivoting actuator 220) can cause the movement of the entire governor linkage 110 rather than just a portion of it. Specifically, for example, actuator A can be a lever-based system discussed above in which blade brake clutch control BBC moves connector 226, which in turn causes lever 222 to pivot and thereby move actuator rod 224. As discussed above, actuator rod 224 can engage a linkage slot in governor linkage 110 (See, e.g., linkage slot 138 in FIGS. 5A and 5B), or actuator rod 224 can itself contain an actuator slot that can engage a raised feature on governor linkage 110 (See, e.g., actuator slot 208 in FIG. 4 for engagement with raised feature 136 in FIGS. 3A through 3C). Alternatively, as shown in FIG. 7, actuator rod 224 can have a substantially hook-shaped end for engagement with governor linkage 110.

As with the other configurations discussed above, actuator rod 224 can be such that it is not fixedly connected to governor linkage 110 such that any action of pivoting actuator 220 would necessarily result in movement of governor linkage 110. Rather, the connection between actuator rod 224 and governor linkage 110 can be relatively "flexible" in that actuator rod 224 can be configured such that actuator rod 224 will travel at least a small amount before applying a force to move governor linkage 110. Further, this connection can be such that even when actuator rod 224 applies a force to move governor linkage 110, governor linkage 110 is still free to continue moving beyond the adjusted base position dictated by pivoting actuator 220. In other words, for instance, when blade brake clutch control BBC is released, thereby causing pivoting actuator 220 to move governor linkage 110 from a base position towards an adjusted, throttle-closed position, governor linkage 110 can still rotate further to reduce the throttle in the course of the normal operation of governor G.

Regardless of the specific configuration of governor linkage 110 and/or actuator A, automatic idle system 100 can operate to idle down engine E when it is not in a loaded state. For example, where automatic idle system 100 is incorporated into a lawnmower, engine E can idle down the lawnmower operator is not actively mowing. Further, automatic idle system 100 can enable high-speed transport of the lawnmower even when the engine is not being used to mow.

The present subject matter can be embodied in other forms without departure from the spirit and essential characteristics thereof. The embodiments described therefore are to be considered in all respects as illustrative and not restrictive. Although the present subject matter has been described in terms of certain preferred embodiments, other embodiments that may be apparent to those of ordinary skill in the art are also within the scope of the present subject matter.

What is claimed is:

1. An automatic idle system for an engine comprising:

an engine drivingly engaged to a rotary blade, the engine comprising an adjustable throttle and a blade brake clutch control;

an engine speed governor for connection to an engine, the engine speed governor comprising a governor shaft rotatable in response to a speed of the engine;

a governor linkage comprising a first portion containing a first end for connection to the governor shaft and a second portion containing a second end for connection to an engine throttle control, the second portion being pivotably coupled to the first portion at a pivot point; and an actuator connected to the blade brake clutch control and to the second end of the governor linkage, the actuator being movable in response to operation of the blade brake clutch control to pivot the second portion relative to the first portion from a base position to an adjusted position;

wherein the actuator is configured to automatically move the second portion toward a throttle-closed position upon disengagement of the blade brake clutch control.

2. The automatic idle system of claim 1, wherein the governor linkage comprises a governor rod and a governor rod spring for connecting the second end to the throttle control.

3. The automatic idle system of claim 1, wherein the governor linkage comprises a governor spring for connecting the first end to a fixed frame element.

4. The automatic idle system of claim 1, wherein the actuator comprises:

a pivotable lever movable in response to operation of the blade brake clutch control;

an actuation rod having a first end attached to the pivotable lever and a second end coupled to the second portion of the governor linkage.

5. The automatic idle system of claim 4, wherein the second portion comprises an elongated slot into which the second end of the actuation rod is received.

6. The automatic idle system of claim 4, wherein the actuation rod comprises an elongated slot coupled to a raised feature on the second portion.

7. An automatic idle system comprising:

an engine drivingly engaged to a rotary blade, the engine comprising an adjustable throttle and a blade brake clutch control;

an engine speed governor coupled to the engine, the engine speed governor comprising a governor shaft rotatable in response to a speed of the engine;

a governor linkage comprising a first end for connection to the governor shaft and a second end for connection to a throttle control of the engine; and an actuator connected to the blade brake clutch control and to the second end of the governor linkage, the actuator being movable in response to operation of the blade brake clutch control to move the governor linkage from a base position to an adjusted position;

wherein the actuator is configured to automatically move the governor linkage toward a throttle-closed position upon disengagement of the blade brake clutch control.

8. The automatic idle system of claim 7, wherein the governor linkage comprises a governor rod and a governor rod spring connecting the second end to the throttle control.

9. The automatic idle system of claim 7, wherein the governor linkage comprises a governor spring connecting the first end to a fixed frame element.

10. The automatic idle system of claim 7, wherein the actuator comprises:

a pivotable lever movable in response to a operation of the blade brake clutch control;

an actuation rod having a first end attached to the pivotable lever and a second end coupled to the second end of the governor linkage.

11. The automatic idle system of claim 10, wherein the second end comprises an elongated slot into which the second end of the actuation rod is received.

12. The automatic idle system of claim 10, wherein the actuation rod comprises an elongated slot coupled to a raised feature on the second portion.

13. A method for automatically adjusting the speed of an engine comprising:

coupling an engine speed governor to an engine that is drivingly engaged to a rotary blade, the engine comprising an adjustable throttle and a blade brake clutch control, the engine speed governor comprising a governor shaft rotatable in response to a speed of the engine;

connecting a governor linkage between the governor shaft and a throttle control of the adjustable throttle, the governor linkage comprising a first end connected to the governor shaft and a second end connected to the throttle control; and automatically moving an actuator in response to the operation of the blade brake clutch control to move the governor linkage from a base position to an adjusted position;

wherein when the blade brake clutch control is moved to a disengaged position, the governor linkage is moved toward a throttle-closed position.

14. The method of claim 13, wherein moving the actuator comprises moving a vacuum actuator in response to an engine intake pressure of the engine.

15. The method of claim 13, further comprising returning the governor linkage to the base position when the blade brake control is moved to an engaged position.

* * * * *